US009874168B2

(12) United States Patent
Thomas et al.

(10) Patent No.: US 9,874,168 B2
(45) Date of Patent: Jan. 23, 2018

(54) METHODS AND SYSTEMS FOR A DUAL INJECTION FUEL SYSTEM

(71) Applicant: Ford Global Technologies, LLC, Dearborn, MI (US)

(72) Inventors: Joseph Lyle Thomas, Kimball, MI (US); Xiaoying Zhang, Dearborn Heights, MI (US); Daniel Dusa, West Blloomfield, MI (US); Paul Hollar, Belleville, MI (US); Ethan D. Sanborn, Saline, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 93 days.

(21) Appl. No.: 14/803,853

(22) Filed: Jul. 20, 2015

(65) Prior Publication Data

US 2017/0022917 A1 Jan. 26, 2017

(51) Int. Cl.

*F02D 41/00* (2006.01)
*F02D 41/06* (2006.01)
*F02D 41/30* (2006.01)

(52) U.S. Cl.

CPC ..... *F02D 41/062* (2013.01); *F02D 41/3094* (2013.01); *F02D 41/064* (2013.01); *F02D 41/065* (2013.01)

(58) Field of Classification Search

CPC ..... F02M 1/16; F02M 69/046; F02M 37/20; F02D 41/062; F02D 41/3094; F02D 41/064; F02D 41/065

USPC ..... 123/179.9, 431; 701/104

See application file for complete search history.

(56) References Cited

U.S. PATENT DOCUMENTS 5,743,236 A * 4/1998 Kawakami ..... F02D 41/0002 123/491
5,927,253 A * 7/1999 Oyafuso ..... F02D 41/062 123/456
6,701,900 B1 * 3/2004 Millar ..... F02M 37/20 123/461
8,100,107 B2 1/2012 Bidner et al.
2008/0314349 A1 12/2008 Oertel et al.
2010/0063712 A1 3/2010 Bromberg et al.
2010/0212640 A1 * 8/2010 Lucido ..... F02D 41/062 123/516
2017/0030322 A1 * 2/2017 Glugla ..... F02D 41/005

FOREIGN PATENT DOCUMENTS

WO 2014089304 A1 6/2014

* cited by examiner

*Primary Examiner* — Hai Huynh
*Assistant Examiner* — Gonzalo Laguarda
(74) *Attorney, Agent, or Firm* — Julia Voutyras; McCoy Russell LLP

(57) ABSTRACT

Methods and systems are provided for controlling fuel injectors for a fuel system configured to deliver fuel to an engine via each of port fuel injection and direct fuel injection. In one example, a method may include, during an engine green start condition, injecting fuel with the port injector while not injecting fuel with the direct injector, and after the green start condition, injecting with each of the port injector and the direct fuel injector at a fuel ratio determined based on engine operating conditions.

20 Claims, 5 Drawing Sheets

METHODS AND SYSTEMS FOR A DUAL INJECTION FUEL SYSTEM

FIELD

The present description relates generally to methods and systems for controlling a green engine of a vehicle after vehicle assembly.

BACKGROUND/SUMMARY

Vehicles often include a fuel system configured to provide desired amounts of fuel to combustion chambers or cylinders of a vehicle engine at precise times. In one example, such fuel systems include a fuel injector configured to inject fuel into an intake manifold coupled to the cylinder in a manner known as port fuel injection. Additionally or alternatively, the fuel system may include a fuel injector configured to inject fuel directly into the cylinder in a manner known as direct fuel injection. Injecting fuel via direct injection requires injecting fuel at a higher pressure as compared to port fuel injection in order to meet the timing demands of fuel combustion. For this reason, a high pressure fuel pump is often included with a direct injection system in order to pressurize fuel in a direct injection fuel rail supplying fuel to the direct injector.

After a vehicle has been assembled at an assembly plant, each vehicle subsystem may be tested. This ensures that each subsystem is functioning properly after the vehicle has left the assembly plant, such as when the vehicle is delivered to a customer. The first key-on event of a vehicle engine, which may occur after vehicle assembly and before the departure of the vehicle from the manufacturing plant and/or before the sale of the vehicle, may be associated with an engine green start condition. In some examples, an engine green start condition may span a number of key-on events of the engine while the vehicle is still at the assembly plant, during which time a number of functions of the vehicle are tested to ensure vehicle quality. For example, a fuel system may be tested in conjunction with the engine to ensure that fuel is being injected properly into the combustion cylinders (e.g., testing whether injection timing, injection mass, etc. are occurring as predicted/desired). Still other vehicle subsystem tests may require a running engine for completion.

However, during a first key-on event after the assembly of a vehicle, fuel system components may be filled with at least some air. As a result, during an engine green start condition, a fuel pressure at a direct fuel injector may not be high enough to accurately inject a commanded fuel mass. In addition to causing fuel metering errors, until the direct injection fuel rail pressure is adequately high, the injected fuel may not adequately mix with air in the combustion cylinder, resulting in increased soot emissions. Furthermore, for both of these reasons, the engine may stall or not start at all if operating via direct injection during an engine green start condition. Therefore it is desirable not to operate a vehicle with direct injection until the direct injection fuel rail has been adequately primed, that is until the rail has been supplied with fuel at or above a threshold pressure and has been purged of air.

Attempts to prime a fuel system during green start conditions include retarding spark timing until the engine is primed. One example approach is shown by Oertel et al. in U.S. 2008/0314349. Therein, in response to a detected green start condition, an ignition sequence is activated and spark timing is retarded from a normal spark timing (e.g., adjusted to be later than a default spark timing). In this way, air is purged from the direct injection fuel rail via the direct injectors and the ignition of residual fuel in the direct injection fuel rail is rendered insufficient to start the engine. As a result, the engine is not started until the direct injection fuel rail has been sufficiently purged of air and fuel has been introduced thereto.

However, the inventors herein have recognized potential issues with such systems. As one example, combusting fuel at imprecise air-fuel ratios and directly injecting fuel at lower pressures may result in increased soot emissions. Additionally, in fuel systems including both port fuel injection and direct injection, time spent priming the direct injection fuel rail may increase the initial test time, thereby increasing the amount of time the vehicle has to spend at the plant.

In one example, the issues described above may be addressed by a method for controlling fuel injection to an engine, comprising, in response to an engine green start event, injecting fuel to the engine via a port injector while priming a direct injection fuel rail. In this way, engine green starts may be improved.

As one example, in a vehicle configured with an engine having dual fuel injection capabilities, responsive to a first key-on event occurring after the vehicle has been assembled but before the vehicle has left the planet (that is, during an engine green start condition), port fuel injectors may be activated while direct fuel injectors may be deactivated. A high pressure pump configured to pressurize each of the port injection fuel rail and the direct injection fuel rail may be operated to maintain or increase the fuel pressure in each fuel rail. The engine may then be fueled via only the port fuel injectors until a pressure within the direct injection fuel rail is sufficiently high (e.g., has exceeded a threshold pressure). The direct injectors may be intermittently enabled to allow air in the fuel rail to be purged into the combustion chamber. Once the direct injection fuel rail pressure is high enough to ensure accurate direct fuel metering, the direct injectors may be reactivated and the engine may be fueled via both port and direct fuel injection at an injection ratio determined based on engine operating conditions, such as engine temperature.

The technical effect of fueling a green engine via port injection during the priming of a direct injection fuel rail is that fueling errors may be reduced without increasing exhaust emissions. In addition, by priming the direct injection fuel rail while simultaneously running the engine via port fuel injection, the duration of a green start testing procedure may be reduced, thereby reducing the amount of time a vehicle has to be held at a plant after production.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 4:
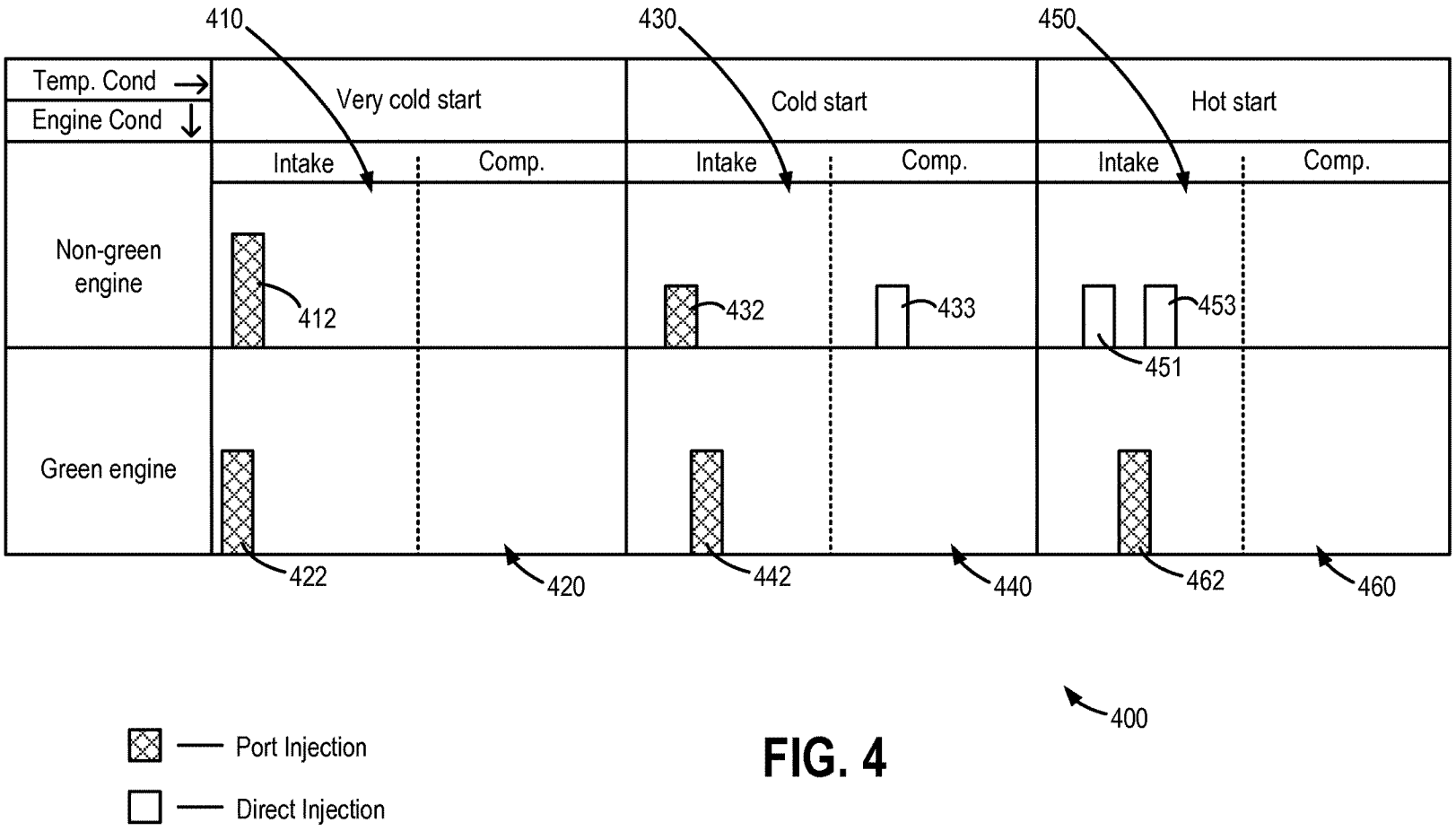
FIG. 4 depicts a flow chart of a method for priming a direct injection fuel rail during a green start event.
Figure 5:
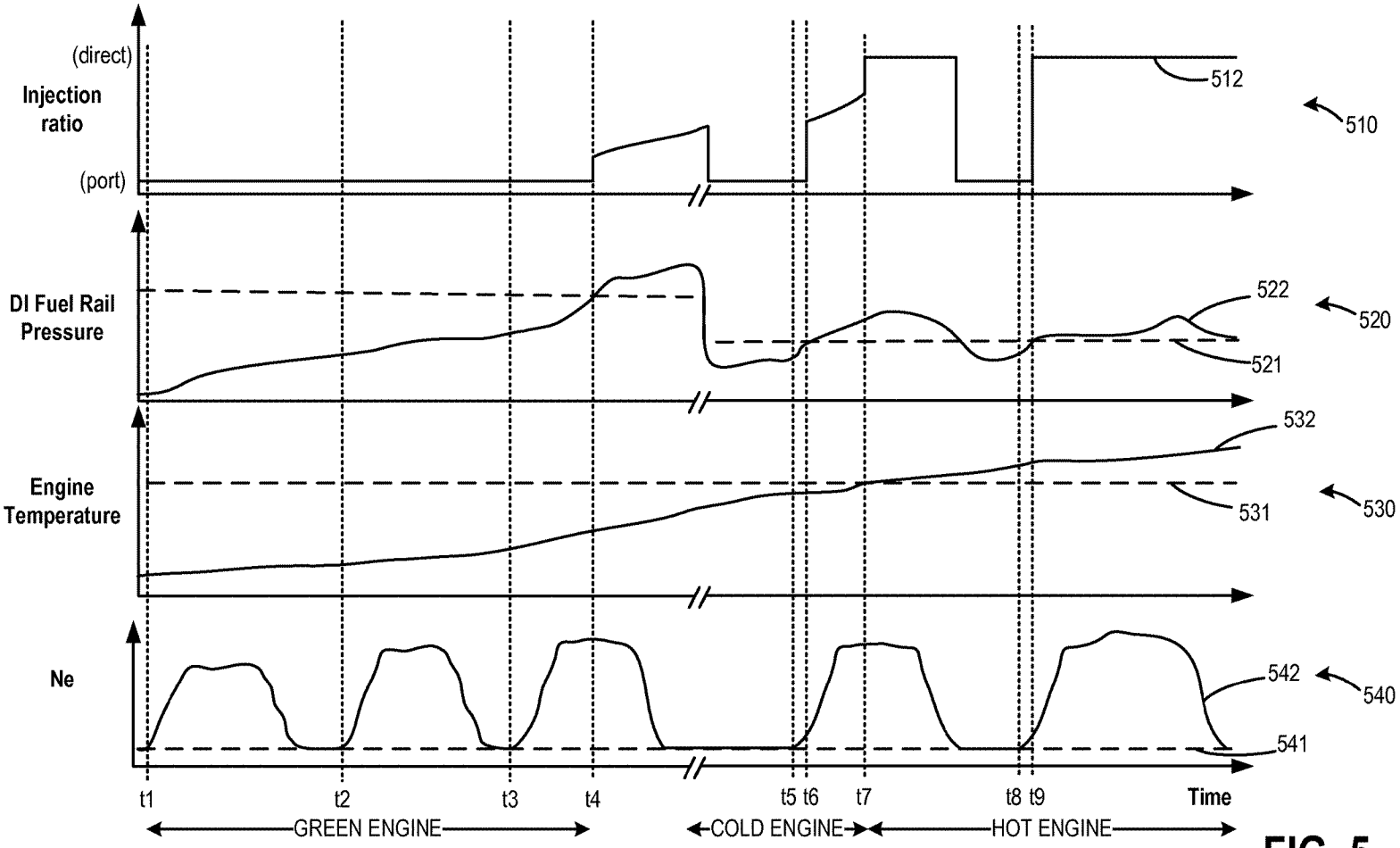
FIG. 5 shows an example timeline of direct injection fuel rail priming responsive to an engine green start condition, and further shows an example fuel injection ratio adjustment responsive to engine temperature, according to the present disclosure.

The following description relates to systems and methods for adjusting a fuel injection ratio of a dual injection fuel system during a green start. An example embodiment of a cylinder in an internal combustion engine is given in FIG. 1 while FIG. 2 depicts a dual injection fuel system that may be used with the engine of FIG. 1. A high pressure pump with mechanical pressure regulation and related fuel system components, shown in detail at FIG. 2, enables the port injection fuel rail to be operated at a pressure higher than the default pressure of a lift pump while concurrently enabling the direct injection fuel rail to be operated in a variable high pressure range. A controller may be configured to perform a control routine, such as the example routine of FIG. 3, to prime the direct injection fuel rail during an engine green start condition, using only port injection. Thereafter, the engine fuel injection may transition to a profile including port and/or direct injection based on engine operating conditions. Example fuel injection profiles for a number of engine start conditions are shown at FIG. 4. An example engine green start fuel injection adjustment is shown at FIG. 5.

Regarding terminology used throughout this detailed description, a high pressure pump, or direct injection pump, may be abbreviated as a DI or HP pump. Similarly, a low pressure pump, or lift pump, may be abbreviated as a LP pump. Port fuel injection may be abbreviated as PFI while direct injection may be abbreviated as DI. Also, fuel rail pressure, or the value of pressure of fuel within a fuel rail, may be abbreviated as FRP. Also, the mechanically operated inlet check valve for controlling fuel flow into the HP pump may also be referred to as the spill valve. As discussed in more detail below, an HP pump that relies on mechanical pressure regulation without use of an electronically-controlled inlet valve may be referred to as a mechanically-controlled HP pump, or HP pump with mechanically-regulated pressure. Mechanically-controlled HP pumps, while not using electronically-controlled inlet valves for regulating a volume of fuel pumped, may provide one or more discrete pressures based on electronic selection.

Figure 1:
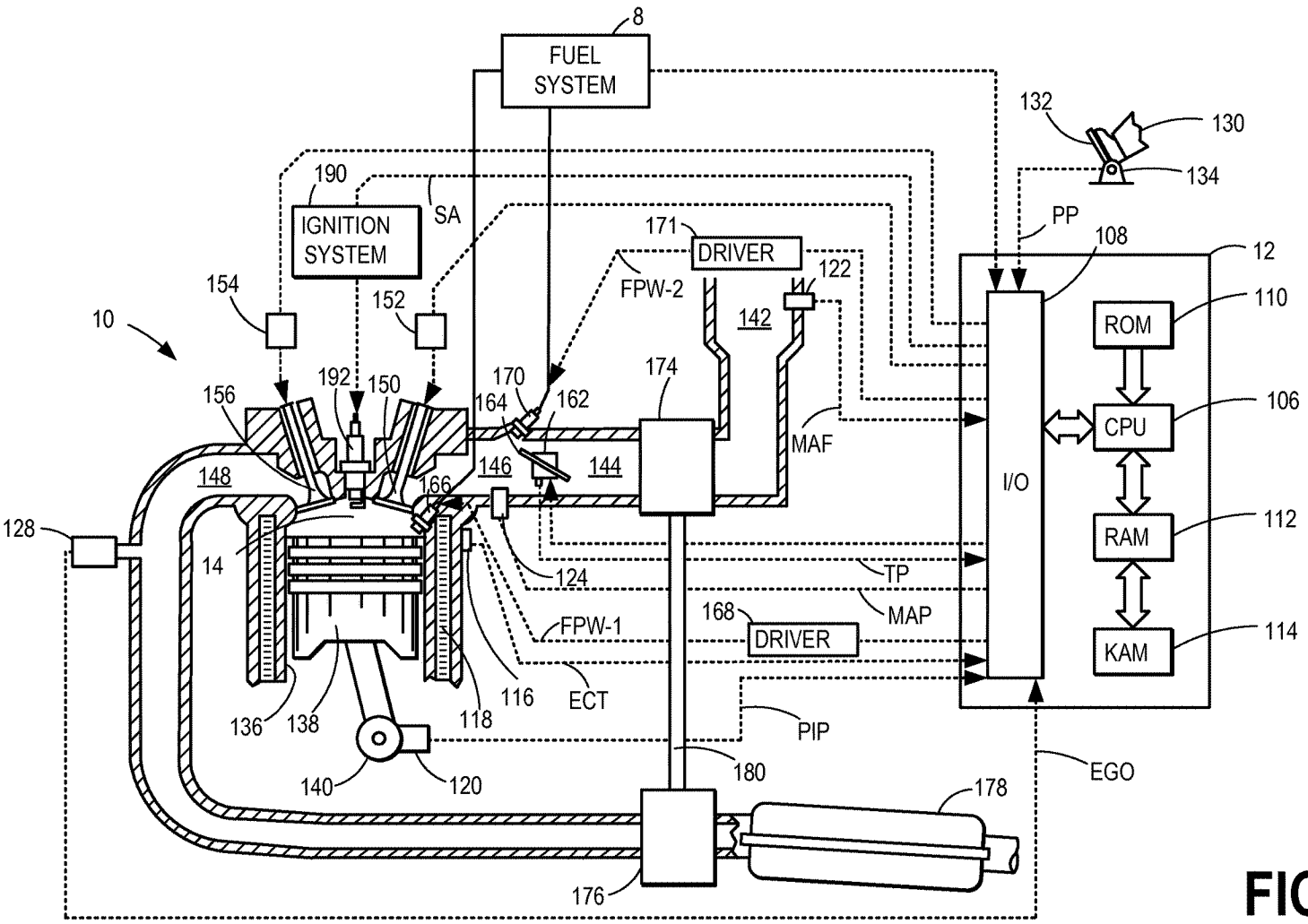
FIG. 1 schematically depicts an example embodiment of a cylinder of an internal combustion engine.
Figure 2:
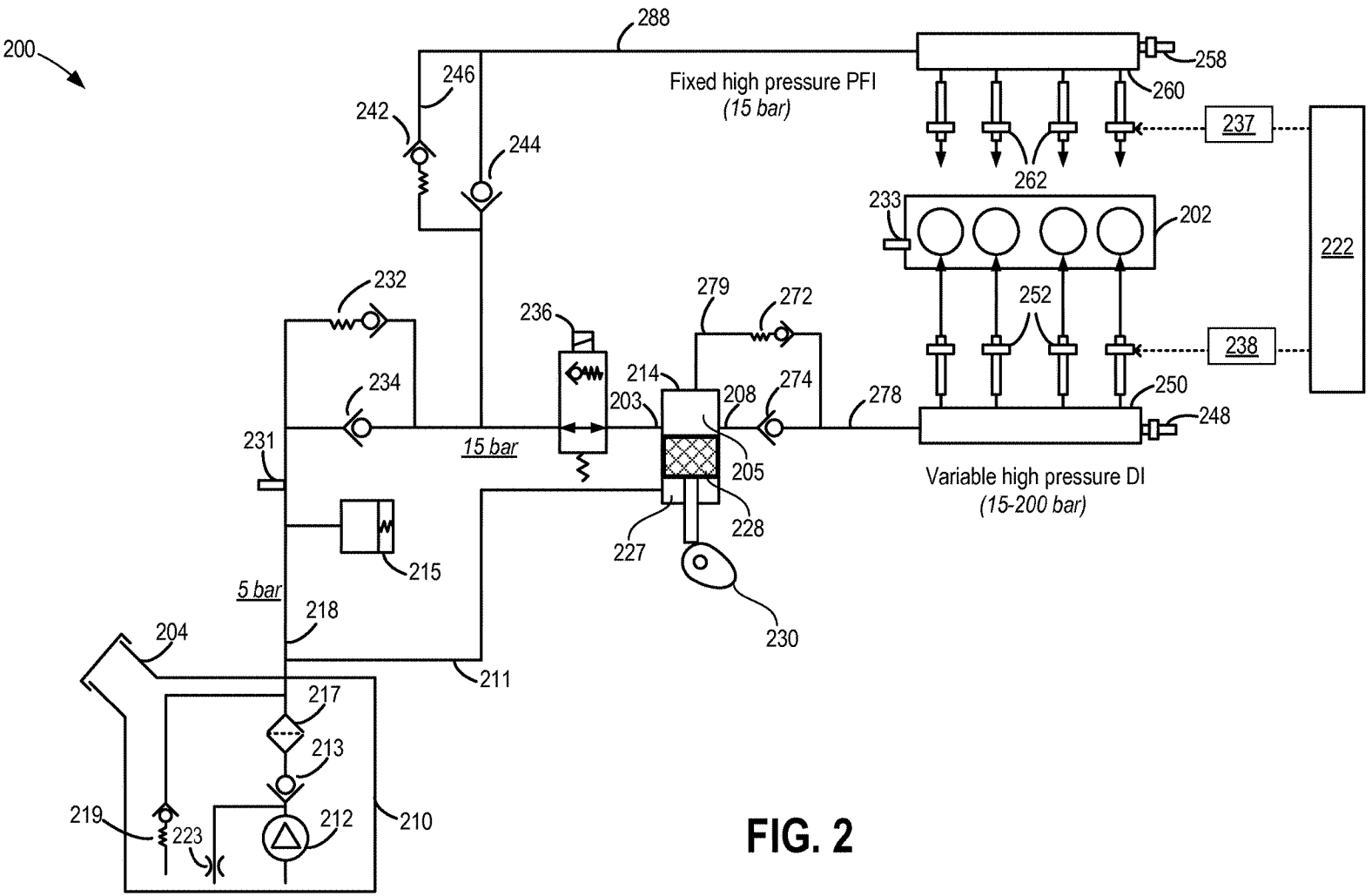
FIG. 2 schematically depicts an example embodiment of a fuel system including a high pressure fuel pump configured to mechanically pressurize each of a port and a direct injection fuel rail of the engine of FIG. 1.

FIG. 1 depicts an example of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT), and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. As elaborated with reference to FIGS. 2 and 3, fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In still another example, both fuels may be alcohol blends with varying alcohol composition wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities such as a difference in temperature, viscosity, octane number, etc. Moreover, fuel characteristics of one or both fuel tanks may vary frequently, for example, due to day to day variations in tank refilling.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus.

Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Controller 12 may infer an engine temperature based on an engine coolant temperature.

FIG. 2 schematically depicts an example embodiment 200 of a fuel system, such as fuel system 8 of FIG. 1. Fuel system 200 may be operated to deliver fuel to an engine, such as engine 10 of FIG. 1. Fuel system 200 may be operated by a controller to perform some or all of the operations described with reference to the process flows of FIG. 4.

Fuel system 200 includes a fuel storage tank 210 for storing the fuel on-board the vehicle, a lower pressure fuel pump (LPP) 212 (herein also referred to as fuel lift pump 212), and a higher pressure fuel pump (HPP) 214 (herein also referred to as fuel injection pump 214). Fuel may be provided to fuel tank 210 via fuel filling passage 204. In one example, LPP 212 may be an electrically-powered lower pressure fuel pump disposed at least partially within fuel tank 210. LPP 212 may be operated by a controller 222 (e.g., controller 12 of FIG. 1) to provide fuel to HPP 214 via fuel passage 218. LPP 212 can be configured as what may be referred to as a fuel lift pump. As one example, LPP 212 may be a turbine (e.g., centrifugal) pump including an electric (e.g., DC) pump motor, whereby the pressure increase across the pump and/or the volumetric flow rate through the pump may be controlled by varying the electrical power provided to the pump motor, thereby increasing or decreasing the motor speed. For example, as the controller reduces the electrical power that is provided to lift pump 212, the volumetric flow rate and/or pressure increase across the lift pump may be reduced. The volumetric flow rate and/or pressure increase across the pump may be increased by increasing the electrical power that is provided to lift pump 212. As one example, the electrical power supplied to the lower pressure pump motor can be obtained from an alternator or other energy storage device on-board the vehicle (not shown), whereby the control system can control the electrical load that is used to power the lower pressure pump. Thus, by varying the voltage and/or current provided to the lower pressure fuel pump, the flow rate and pressure of the fuel provided at the inlet of the higher pressure fuel pump 214 is adjusted.

LPP 212 may be fluidly coupled to a filter 217, which may remove small impurities contained in the fuel that could potentially damage fuel handling components. A check valve 213, which may facilitate fuel delivery and maintain fuel line pressure, may be positioned fluidly upstream of filter 217. With check valve 213 upstream of the filter 217, the compliance of low-pressure passage 218 may be increased since the filter may be physically large in volume. Furthermore, a pressure relief valve 219 may be employed to limit the fuel pressure in low-pressure passage 218 (e.g., the output from lift pump 212). Relief valve 219 may include a ball and spring mechanism that seats and seals at a specified pressure differential, for example. The pressure differential set-point at which relief valve 219 may be configured to open may assume various suitable values; as a non-limiting example the set-point may be 6.4 bar or 5 bar (g). An orifice 223 may be utilized to allow for air and/or fuel vapor to bleed out of the lift pump 212. This bleed at 223 may also be used to power a jet pump used to transfer fuel from one location to another within the tank 210. In one example, an orifice check valve (not shown) may be placed in series with orifice 223. In some embodiments, fuel system 8 may include one or more (e.g., a series) of check valves fluidly coupled to low-pressure fuel pump 212 to impede fuel from leaking back upstream of the valves. In this context, upstream flow refers to fuel flow traveling from fuel rails 250, 260 towards LPP 212 while downstream flow refers to the nominal fuel flow direction from the LPP towards the HPP 214 and thereon to the fuel rails.

Fuel lifted by LPP 212 may be supplied at a lower pressure into a fuel passage 218 leading to an inlet 203 of HPP 214. HPP 214 may then deliver fuel into a first fuel rail 250 coupled to one or more fuel injectors of a first group of direct injectors 252 (herein also referred to as a first injector group). Fuel lifted by the LPP 212 may also be supplied to a second fuel rail 260 coupled to one or more fuel injectors of a second group of port injectors 262 (herein also referred to as a second injector group). As elaborated below, HPP 214 may be operated to raise the pressure of fuel delivered to each of the first and second fuel rail above the lift pump pressure, with the first fuel rail coupled to the direct injector group operating with a variable high pressure while the second fuel rail coupled to the port injector group operates with a fixed high pressure. As a result, high pressure port and direct injection may be enabled. The high pressure fuel pump is coupled downstream of the low pressure lift pump with no additional pump positioned in between the high pressure fuel pump and the low pressure lift pump.

While each of first fuel rail 250 and second fuel rail 260 are shown dispensing fuel to four fuel injectors of the respective injector group 252, 262, it will be appreciated that each fuel rail 250, 260 may dispense fuel to any suitable number of fuel injectors. As one example, first fuel rail 250 may dispense fuel to one fuel injector of first injector group 252 for each cylinder of the engine while second fuel rail 260 may dispense fuel to one fuel injector of second injector group 262 for each cylinder of the engine. Controller 222 can individually actuate each of the port injectors 262 via a port injection driver 237 and actuate each of the direct injectors 252 via a direct injection driver 238. The controller 222, the drivers 237, 238 and other suitable engine system controllers can comprise a control system. While the drivers 237, 238 are shown external to the controller 222, it should be appreciated that in other examples, the controller 222 can include the drivers 237, 238 or can be configured to provide the functionality of the drivers 237, 238. Controller 222 may include additional components not shown, such as those included in controller 12 of FIG. 1.

HPP 214 may be an engine-driven, positive-displacement pump. As one non-limiting example, HPP 214 may be a BOSCH HDP5 HIGH PRESSURE PUMP, which utilizes a solenoid activated control valve (e.g., fuel volume regulator, magnetic solenoid valve, etc.) 236 to vary the effective pump volume of each pump stroke. The outlet check valve of HPP is mechanically controlled and not electronically controlled by an external controller. HPP 214 may be mechanically driven by the engine in contrast to the motor driven LPP 212. HPP 214 includes a pump piston 228, a pump compression chamber 205 (herein also referred to as compression chamber), and a step-room 227. Pump piston 228 receives a mechanical input from the engine crank shaft or cam shaft via cam 230, thereby operating the HPP according to the principle of a cam-driven single-cylinder pump. A sensor (not shown in FIG. 2) may be positioned near cam 230 to enable determination of the angular position of the cam (e.g., between 0 and 360 degrees), which may be relayed to controller 222.

Fuel system 200 may optionally further include accumulator 215. When included, accumulator 215 may be positioned downstream of lower pressure fuel pump 212 and upstream of higher pressure fuel pump 214, and may be configured to hold a volume of fuel that reduces the rate of fuel pressure increase or decrease between fuel pumps 212 and 214. For example, accumulator 215 may be coupled in fuel passage 218, as shown, or in a bypass passage 211 coupling fuel passage 218 to the step-room 227 of HPP 214. The volume of accumulator 215 may be sized such that the engine can operate at idle conditions for a predetermined period of time between operating intervals of lower pressure fuel pump 212. For example, accumulator 215 can be sized such that when the engine idles, it takes one or more minutes to deplete pressure in the accumulator to a level at which higher pressure fuel pump 214 is incapable of maintaining a sufficiently high fuel pressure for fuel injectors 252, 262. Accumulator 215 may thus enable an intermittent operation mode (or pulsed mode) of lower pressure fuel pump 212. By reducing the frequency of LPP operation, power consumption is reduced. In other embodiments, accumulator 215 may inherently exist in the compliance of fuel filter 217 and fuel passage 218, and thus may not exist as a distinct element.

A lift pump fuel pressure sensor 231 may be positioned along fuel passage 218 between lift pump 212 and higher pressure fuel pump 214. In this configuration, readings from sensor 231 may be interpreted as indications of the fuel pressure of lift pump 212 (e.g., the outlet fuel pressure of the lift pump) and/or of the inlet pressure of higher pressure fuel pump. Readings from sensor 231 may be used to assess the operation of various components in fuel system 200, to determine whether sufficient fuel pressure is provided to higher pressure fuel pump 214 so that the higher pressure fuel pump ingests liquid fuel and not fuel vapor, and/or to minimize the average electrical power supplied to lift pump 212. While lift pump fuel pressure sensor 231 is shown as being positioned downstream of accumulator 215, in other embodiments the sensor may be positioned upstream of the accumulator.

First fuel rail 250 includes a first fuel rail pressure sensor 248 for providing an indication of direct injection fuel rail pressure to the controller 222. Likewise, second fuel rail 260 includes a second fuel rail pressure sensor 258 for providing an indication of port injection fuel rail pressure to the controller 222. An engine speed sensor 233 can be used to provide an indication of engine speed to the controller 222. The indication of engine speed can be used to identify the speed of higher pressure fuel pump 214, since the pump 214 is mechanically driven by the engine 202, for example, via the crankshaft or camshaft.

First fuel rail 250 is coupled to an outlet 208 of HPP 214 along fuel passage 278. In comparison, second fuel rail 260 is coupled to an inlet 203 of HPP 214 via fuel passage 288. A check valve and a pressure relief valve may be positioned between the outlet 208 of the HPP 214 and the first fuel rail. In addition, pressure relief valve 272, arranged parallel to check valve 274 in bypass passage 279, may limit the pressure in fuel passage 278, located downstream of HPP 214 and upstream of first fuel rail 250. For example, pressure relief valve 272 may limit the pressure in fuel passage 278 to 200 bar. As such, pressure relief valve 272 may limit the pressure that would otherwise be generated in fuel passage 278 if control valve 236 were (intentionally or unintentionally) open and while high pressure fuel pump 214 were pumping.

One or more check valves and pressure relief valves may also be coupled to fuel passage 218, downstream of LPP 212 and upstream of HPP 214. For example, check valve 234 may be provided in fuel passage 218 to reduce or prevent back-flow of fuel from high pressure pump 214 to low pressure pump 212 and fuel tank 210. In addition, pressure relief valve 232 may be provided in a bypass passage, positioned parallel to check valve 234. Pressure relief valve 232 may limit the pressure to its left to 10 bar higher than the pressure at sensor 231.

Controller 222 may be configured to regulate fuel flow into HPP 214 through control valve 236 by energizing or de-energizing the solenoid valve (based on the solenoid valve configuration) in synchronism with the driving cam. Accordingly, the solenoid activated control valve 236 may be operated in a first mode where the valve 236 is positioned within HPP inlet 203 to limit (e.g., inhibit) the amount of fuel traveling through the solenoid activated control valve 236. Depending on the timing of the solenoid valve actuation, the volume transferred to the fuel rail 250 is varied. The solenoid valve may also be operated in a second mode where the solenoid activated control valve 236 is effectively disabled and fuel can travel upstream and downstream of the valve, and in and out of HPP 214.

As such, solenoid activated control valve 236 may be configured to regulate the mass (or volume) of fuel compressed into the direct injection fuel pump. In one example, controller 222 may adjust a closing timing of the solenoid pressure control check valve to regulate the mass of fuel compressed. For example, a late pressure control valve closing may reduce the amount of fuel mass ingested into compression chamber 205. The solenoid activated check valve opening and closing timings may be coordinated with respect to stroke timings of the direct injection fuel pump.

Pressure relief valve 232 allows fuel flow out of solenoid activated control valve 236 toward the LPP 212 when pressure between pressure relief valve 232 and solenoid operated control valve 236 is greater than a predetermined pressure (e.g., 10 bar). When solenoid operated control valve 236 is deactivated (e.g., not electrically energized), solenoid operated control valve operates in a pass-through mode and pressure relief valve 232 regulates pressure in compression chamber 205 to the single pressure relief set-point of pressure relief valve 232 (e.g., 10 bar above the pressure at sensor 231). Regulating the pressure in compression chamber 205 allows a pressure differential to form from the piston top to the piston bottom. The pressure in step-room 227 is at the pressure of the outlet of the low pressure pump (e.g., 5 bar) while the pressure at piston top is at pressure relief valve regulation pressure (e.g., 15 bar). The pressure differential allows fuel to seep from the piston top to the piston bottom through the clearance between the piston and the pump cylinder wall, thereby lubricating HPP 214.

Piston 228 reciprocates up and down. HPP 214 is in a compression stroke when piston 228 is traveling in a direction that reduces the volume of compression chamber 205. HPP 214 is in a suction stroke when piston 228 is traveling in a direction that increases the volume of compression chamber 205.

A forward flow outlet check valve 274 may be coupled downstream of an outlet 208 of the compression chamber 205. Outlet check valve 274 opens to allow fuel to flow from the high pressure pump outlet 208 into a fuel rail only when a pressure at the outlet of direct injection fuel pump 214 (e.g., a compression chamber outlet pressure) is higher than the fuel rail pressure. Thus, during conditions when direct injection fuel pump operation is not requested, controller 222 may deactivate solenoid activated control valve 236 and pressure relief valve 232 regulates pressure in compression chamber 205 to a single substantially constant pressure during most of the compression stroke. On the intake stroke the pressure in compression chamber 205 drops to a pressure near the pressure of the lift pump (212). Lubrication of DI pump 214 may occur when the pressure in compression chamber 205 exceeds the pressure in step-room 227. This difference in pressures may also contribute to pump lubrication when controller 222 deactivates solenoid activated control valve 236. One result of this regulation method is that the fuel rail is regulated to a minimum pressure, approximately the pressure relief of pressure relief valve 232. Thus, if pressure relief valve 232 has a pressure relief setting of 10 bar, the fuel rail pressure becomes 15 bar because this 10 bar adds to the 5 bar of lift pump pressure. Specifically, the fuel pressure in compression chamber 205 is regulated during the compression stroke of direct injection fuel pump 214. Thus, during at least the compression stroke of direct injection fuel pump 214, lubrication is provided to the pump. When direct fuel injection pump enters a suction stroke, fuel pressure in the compression chamber may be reduced while still some level of lubrication may be provided as long as the pressure differential remains. Another pressure relief valve 272 may be placed in parallel with check valve 274. Pressure relief valve 272 allows fuel flow out of the DI fuel rail 250 toward pump outlet 208 when the fuel rail pressure is greater than a predetermined pressure.

As such, while the direct injection fuel pump is reciprocating, the flow of fuel between the piston and bore ensures sufficient pump lubrication and cooling.

The lift pump may be transiently operated in a pulsed mode where the lift pump operation is adjusted based on a pressure estimated at the outlet of the lift pump and inlet of the high pressure pump. In particular, responsive to high pressure pump inlet pressure falling below a fuel vapor pressure, the lift pump may be operated until the inlet pressure is at or above the fuel vapor pressure. This reduces the risk of the high pressure fuel pump ingesting fuel vapors (instead of fuel) and ensuing engine stall events.

It is noted here that the high pressure pump 214 of FIG. 2 is presented as an illustrative example of one possible configuration for a high pressure pump. Components shown in FIG. 2 may be removed and/or changed while additional components not presently shown may be added to pump 214 while still maintaining the ability to deliver high-pressure fuel to a direct injection fuel rail and a port injection fuel rail.

Solenoid activated control valve 236 may also be operated to direct fuel back-flow from the high pressure pump to one of pressure relief valve 232 and accumulator 215. For example, control valve 236 may be operated to generate and store fuel pressure in accumulator 215 for later use. One use of accumulator 215 is to absorb fuel volume flow that results from the opening of compression pressure relief valve 232. Accumulator 227 sources fuel as check valve 234 opens during the intake stroke of pump 214. Another use of accumulator 215 is to absorb/source the volume changes in the step room 227. Yet another use of accumulator 215 is to allow intermittent operation of lift pump 212 to gain an average pump input power reduction over continuous operation.

While the first direct injection fuel rail 250 is coupled to the outlet 208 of HPP 214 (and not to the inlet of HPP 214), second port injection fuel rail 260 is coupled to the inlet 203 of HPP 214 (and not to the outlet of HPP 214). Although inlets, outlets, and the like relative to compression chamber 205 are described herein, it may be appreciated that there may be a single conduit into compression chamber 205. The single conduit may serve as inlet and outlet. In particular, second fuel rail 260 is coupled to HPP inlet 203 at a location upstream of solenoid activated control valve 236 and downstream of check valve 234 and pressure relief valve 232. Further, no additional pump may be required between lift pump 212 and the port injection fuel rail 260. As elaborated below, the specific configuration of the fuel system with the port injection fuel rail coupled to the inlet of the high pressure pump via a pressure relief valve and a check valve enables the pressure at the second fuel rail to be raised via the high pressure pump to a fixed default pressure that is above the default pressure of the lift pump. That is, the fixed high pressure at the port injection fuel rail is derived from the high pressure piston pump.

When the high pressure pump 214 is not reciprocating, such as at key-up before cranking, check valve 244 allows the second fuel rail to fill at 5 bar. As the pump chamber displacement becomes smaller due to the piston moving upward, the fuel flows in one of two directions. If the spill valve 236 is closed, the fuel goes into the high pressure fuel rail 250. If the spill valve 236 is open, the fuel goes either into the low pressure fuel rail 250 or through the compression relief valve 232. In this way, the high pressure fuel pump is operated to deliver fuel at a variable high pressure (such as between 15-200 bar) to the direct fuel injectors 252 via the first fuel rail 250 while also delivering fuel at a fixed high pressure (such as at 15 bar) to the port fuel injectors 262 via the second fuel rail 260. The variable pressure may include a minimum pressure that is at the fixed pressure (as in the system of FIG. 2). In the configuration depicted at FIG. 2, the fixed pressure of the port injection fuel rail is the same as the minimum pressure for the direct injection fuel rail, both being higher than the default pressure of the lift pump. Herein, the fuel delivery from the high pressure pump is controlled via the upstream (solenoid activated) control valve and further via the various check valve and pressure relief valves coupled to the inlet of the high pressure pump. By adjusting operation of the solenoid activated control valve, the fuel pressure at the first fuel rail is raised from the fixed pressure to the variable pressure while maintaining the fixed pressure at the second fuel rail. Valves 244 and 242 work in conjunction to keep the low pressure fuel rail 260 pressurized to 15 bar during the pump inlet stroke. Pressure relief valve 242 simply limits the pressure that can build in fuel rail 250 due to thermal expansion of fuel. A typical pressure relief setting may be 20 bar.

Controller 222 can also control the operation of each of fuel pumps 212, and 214 to adjust an amount, pressure, flow rate, etc., of a fuel delivered to the engine. As one example, controller 12 can vary a pressure setting, a pump stroke amount, a pump duty cycle command, and/or fuel flow rate of the fuel pumps to deliver fuel to different locations of the fuel system. A driver (not shown) electronically coupled to controller 222 may be used to send a control signal to the low pressure pump, as required, to adjust the output (e.g., speed) of the low pressure pump. In some examples, the solenoid valve may be configured such that high pressure fuel pump 214 delivers fuel only to first fuel rail 250, and in such a configuration, second fuel rail 260 may be supplied fuel at the lower outlet pressure of lift pump 212.

Controller 222 may be configured to determine whether the fuel lines are adequately purged of air via a pressure sensor (e.g., first fuel rail pressure sensor 248). Specifically, if fuel pressure is determined to be above a threshold, pressure controller 222 may infer that the fuel rail is purged of air and instead contains pressurized fuel. Controller 222 can control the operation of each of injector groups 252 and 262. For example, controller 222 may control the distribution and/or relative amount of fuel delivered from each injector may vary with operating conditions, such as engine load, knock, and exhaust temperature. Specifically, controller 222 may adjust a direct injection fuel ratio by sending appropriate signals to port fuel injection driver 237 and direct injection 238, which may in turn actuate the respective port fuel injectors 262 and direct injectors 252 with desired pulse-widths for achieving the desired injection ratios. Additionally, controller 222 may selectively enable and disable one or more of the injector groups based on fuel pressure within each rail. For example, based on a signal from first fuel rail pressure sensor 248, controller 222 may selectively activate second injector group 262 while controlling first injector group 252 in a deactivated state via respective injector drivers 237 and 238.

During some conditions, fuel pressure downstream of high pressure fuel pump 214 (e.g., within first fuel rail 250) may be less than a desired value for injecting fuel via direct fuel injectors 252. As one example, following vehicle assembly and during an initial key-on event (herein also referred to as an engine green start), the DI fuel rail 250 may be filled with air and not sufficiently filled with fuel. Thus, during an initial key-on event of the vehicle, direct injection may not be desirable (or even possible) until the fuel rail has been purged of air and a sufficiently high fuel rail pressure has been established (e.g., until a direct injection fuel rail pressure has been increased to a threshold value). As another example, during a key-on event, the DI fuel rail may be purged of air but the direct injection fuel rail pressure may still be below a threshold value for direct injection (e.g., 15 bar). Thus, direct injection may not be possible until the fuel rail pressure has been increased to at least the threshold value. As a result, the direct injection fuel rail may need to be primed.

Priming the direct injection fuel rail may include each of increasing the fuel pressure within the fuel rail to at least the threshold direct injection value and purging air from the fuel rail. It will be appreciated that during a priming event, port fuel injection may be utilized to crank the engine, thereby driving the high pressure pump. Thus, after a number of combustion events fueled by only port fuel injection, fuel pressure within the direct injection fuel rail may increase to a desired pressure for direct injection. The number of combustion events fueled by only port fuel injection during the priming event may vary based on one or more of a DI fuel rail pressure at the key-on event, engine load, engine speed, a desired pressure, and engine temperature. Additionally, air may be purged from the direct injection fuel rail via a cranking of the engine while maintaining the direct injectors 252 in an open position. As another example, air may be purged form the direct injection fuel rail via activating the lift pump while maintaining the direct injectors in an open position. As a still further example, air may be purged from the system via an external vacuum pump. By priming the direct injection fuel rail before activating the direct injectors, soot emissions may be improved. Reducing soot emissions may improve air quality, particularly at the site of vehicle production.

It will be further appreciated that upon an initial key-on event after assembly of a vehicle, a vehicle controller may execute a number of green start diagnostic tests to determine whether subsystems of the vehicle are functioning properly. Some of these tests may require the engine to be running (e.g., a rotating crankshaft) for initiation and/or completion (e.g., an EGR diagnostic, an alternator diagnostic, or a cam timing diagnostic). By operating the engine via PFI during the priming of the DI fuel rail, at least some of the green start tests may be performed before direct injectors are operable. In this way, the time of a green start may be reduced, and therefore a total time the vehicle spends in a plant, before sale of the vehicle, may be reduced.

An example priming process for fuel system 200 may include, upon the initial key-on event after vehicle assembly, activating the port fuel injectors 262 and deactivating the direct fuel injectors 252 in anticipation of priming the DI fuel rail 250. The direct injectors may be maintained in a deactivated state until a primed condition has been reached (e.g., until pressure within DI fuel rail 250 is greater than or equal to a threshold pressure). A number of green start tests may be performed during the priming of the DI fuel rail. After the DI fuel rail has been primed, a ratio of DI injection mass to PFI injection mass may be adjusted based on engine operating conditions. Such a routine is described in further detail with reference to FIGS. 3-5.

Figure 3:
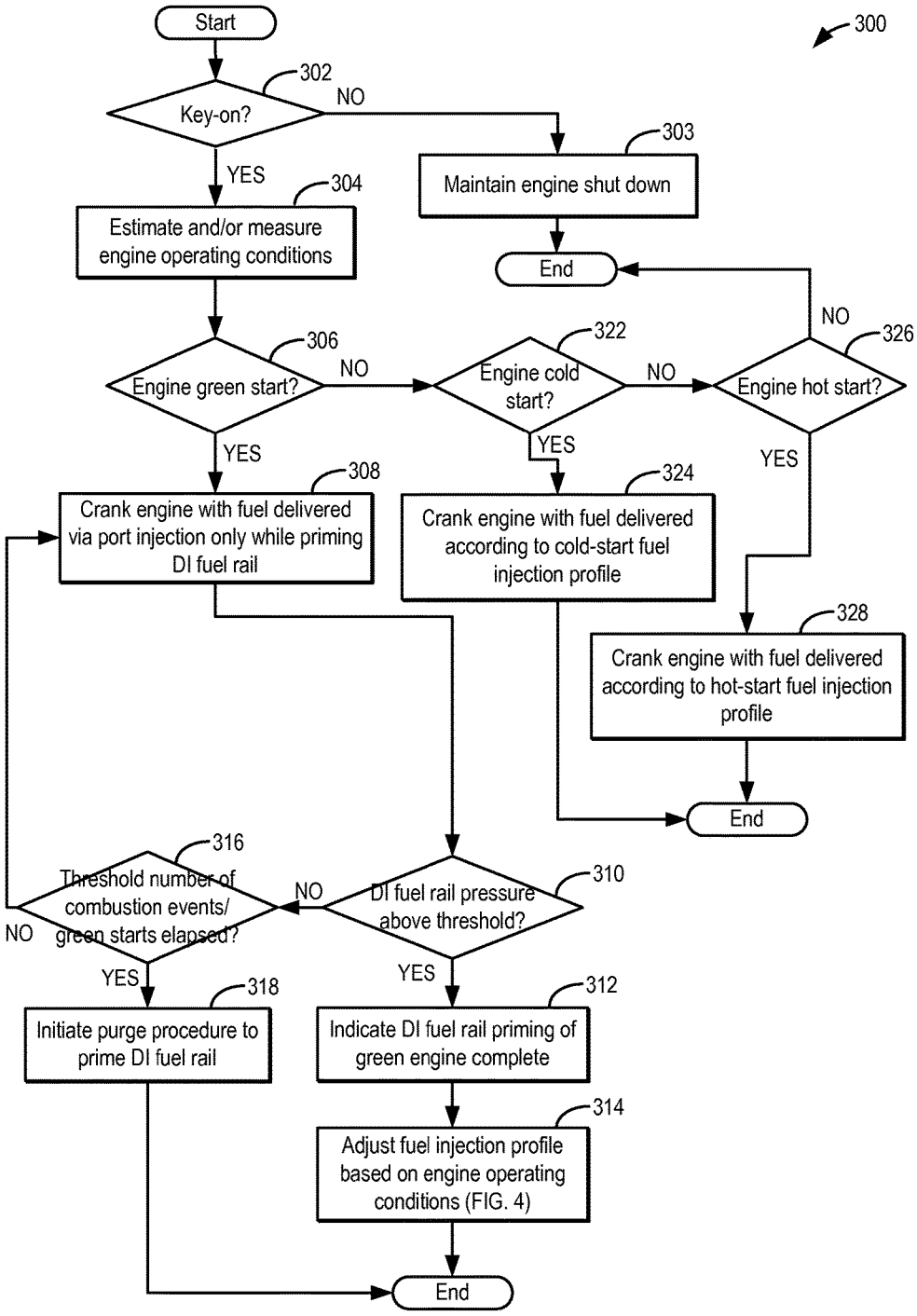
FIG. 3 depicts a flow chart of a method for determining a fuel injection profile during green start conditions.

FIG. 3 provides a routine 300 for priming a dual injection fuel system, and controlling fueling from the dual injection fuel system during engine starting. A fuel injection ratio may be determined via routine 300 based on the presence of an engine green start condition, and further based on engine operating conditions such as engine temperature. Instructions for carrying out method 300 and the rest of the methods included herein may be executed by a controller based on instructions stored on a memory of the controller and in conjunction with signals received from sensors of the engine system, such as the sensors described above with reference to FIGS. 1-2. The controller may employ engine actuators of the engine system to adjust engine operation, according to the methods described below.

Routine 300 begins at 302, where it is determined whether a key-on event is present. A key-on event at 302 may be the initial key-on event after vehicle assembly, or may be any subsequent key-on event. In one example, a key-on event may be confirmed responsive to an operator inserting a vehicle key into an ignition port. In alternate examples, such as where the vehicle is configured with a passive key, a key-on event may be confirmed in response in response to a vehicle operator sitting in the driver seat with the passive key in the vehicle cabin. Further still, a key-on event may be confirmed when a vehicle operator pushes an ignition start/stop button to a start position. If a key-on is confirmed at 302, routine 300 proceeds to 304. Otherwise, routine 300 proceeds to 303 and maintains the engine shut down. After 303, routine 300 exits.

At 304, engine (and vehicle) operating conditions may be estimated and/or measured. Estimating and/or measuring vehicle and engine operating conditions may include, for example, estimating and/or measuring engine speed, engine temperature, ambient conditions (ambient temperature, pressure, humidity, etc.), torque demand, manifold pressure, manifold air flow, canister load, exhaust catalyst conditions, oil temperature, oil pressure, soak time, a position of a fuel pipe of the fuel system, etc. Estimating and/or measuring vehicle and engine operating conditions may include receiving signals from a plurality of sensors, such as the sensors at FIGS. 1-2, and processing these signals in an appropriate manner at an engine controller.

Routine 300 then proceeds to 306, where it is determined whether an engine green start is present. As one example, an engine green start condition may be determined to be present based on a number of key-on events that have elapsed. For example, a green start event may be the first engine start (or a first number of engine starts) following vehicle assembly and before the vehicle leaves the assembly plant. As another example, a green start may be determined to be present based on a direct injection fuel rail pressure (e.g., during an engine green start, fuel pressure in the direct injection fuel rail may be below a threshold pressure). It will be appreciated that the engine green start condition is independent of engine temperature.

A specific example of determining an engine green start condition (i.e., a green engine start condition) based on a number of key-on events may include determining whether a specified duration of engine run time has elapsed since an initial key-on event. An engine green start condition may be determined to be present during the initial key-on event, and for any further number of key-on events that occur within the specified duration of engine run time. Thus, in a first specific example, if the initial key-on event includes running the engine for the specified duration, an engine green start condition may be defined as only the initial key-on event. Alternatively, in a second specific example, if the engine running duration elapses after a first number of key-on events, the green start condition may be defined to include the first number of key-on events. In yet another example, the number may be determined based on an estimated number of key-on events that is sufficient for priming the DI fuel rail and raising the DI fuel rail pressure above a threshold pressure.

In a further example, an engine green start condition may be determined based on a direct injection fuel rail pressure. For example, an engine green start condition may be present if the DI fuel rail pressure is measured to be below a threshold pressure upon engine start (e.g., as estimated by pressure sensor 248 at FIG. 2). For example, with reference to fuel system 200 at FIG. 2, an engine green start condition may be determined to be present if the pressure within DI fuel rail 250 is equivalent to the pressure at the outlet of lift pump 212, and the first threshold pressure is a pressure greater than the threshold pressure of check valve 232. The first threshold pressure may be determined based on a minimum desired pressure for direct injection. In an additional example, after a threshold number of combustion events have elapsed since an initial key-on event, a direct injection amount may be incrementally increased while monitoring a signal from an exhaust gas sensor (e.g., sensor 128 at FIG. 1). In this example, if the signal from the exhaust gas sensor indicates that an air-fuel ratio within a threshold tolerance of stoichiometry is maintained for a threshold number of injection events, it may be determined that the green start condition has elapsed (e.g., is no longer present). Correspondingly, if the DI fuel rail pressure is less than the first threshold pressure, the engine green start condition may be determined to be no longer present when the DI fuel rail pressure rises above the first threshold pressure.

Thus it will be appreciated that while an engine green start condition may always comprise the initial key-on event after vehicle assembly, an engine green start condition may further encompass a number of subsequent and sequentially contiguous key-on events based on a number of example parameters as described above. If an engine green start condition is present, routine 300 proceeds to 308; otherwise, routine 300 proceeds to 322.

At 308, the engine is cranked with fuel delivered via only port injection while priming the DI fuel rail. Put another way, routine 300 comprises, cranking the engine by injecting fuel from a port injector while priming a direct injection fuel rail. Priming the direct injection fuel rail according to routine 300 may further comprise not injecting fuel to the engine via the direct injectors during the priming. Delivering fuel via port injection only may include injecting a desired mass of fuel into a combustion cylinder of an engine (e.g., combustion cylinder 14 at FIG. 1) at a desired position along an engine pump stroke. For example, as described further with reference to FIG. 4, an injection timing of port fuel injection may vary with engine temperature during engine green starts, while a fuel injection ratio of entirely port injection may be maintained throughout the engine green start. Put another way, during engine green start conditions, while a DI fuel rail is being primed, the fuel injection ratio may be independent of factors such as engine temperature and/or manifold temperature. After the DI fuel rail has been primed on the engine green start, the injection ratio may be adjusted. Additionally at 308, the direct injectors may be deactivated if they have not already been deactivated during the present drive cycle. Deactivating the direct injectors may include maintaining the injectors in a closed or disabled state so as to reduce (e.g., prevent) the passage of fuel from the DI fuel rail to the cylinder via the direct injectors. It will be appreciated that the deactivated direct injectors may be intermittently and transiently enabled during the priming to allow air from the DI fuel rail to be purged into the cylinder.

Priming the DI fuel system may also include purging air from the DI fuel rail and pressurizing the DI fuel rail with fuel delivered thereto via a high pressure fuel pump. With reference to the example dual injection fuel system 200 depicted at FIG. 2, priming the DI fuel rail may include controlling spill valve 236 to deliver a first portion of fuel pressurized by each high pressure fuel pump stroke to the PFI fuel rail for maintaining port fuel injection, while delivering a remainder portion of the fuel displaced by each HP fuel pump stroke to the DI fuel rail for increasing the fuel pressure therein. Put another way, each of the port injection fuel rail coupled to the port injector and the direct injection fuel rail may be pressurized via a common high pressure fuel pump. As another example, priming the DI fuel rail may include controlling spill valve to provide the entirety of the fuel pressurized by each high pressure fuel pump stroke to the DI fuel rail, while maintaining the PFI fuel pressure at the outlet pressure of the lift pump.

Still with reference to dual injection fuel system 200, priming the DI fuel system at 406 may further include purging air from each of fuel passage 278 and fuel rail 250 via flowing pressurized liquid fuel from the HPP, through fuel passage 278, and into fuel rail 250, thereby collapsing any air present within the fuel passage and the fuel rail.

In this way, by cranking the engine with fuel injected via only PFI while priming the DI fuel rail, fuel rail priming time may be reduced. Additionally, by disabling the direct injectors until the DI fuel rail is primed, soot emissions may be reduced.

Proceeding now to 310, it is determined whether the DI fuel rail pressure has increased to above the first threshold pressure. Determining whether DI fuel rail pressure has increased to above the first threshold pressure may include determining whether the DI fuel rail pressure has been sustained above the first threshold pressure for a specified duration. In this way, a less volatile determination of the DI fuel rail pressure may be achieved. Put another way, transient increases above the first threshold pressure may be identified as such, and distinguished from a more steady fuel pressure signal above the first threshold pressure.

If DI fuel rail pressure is determined to be above the threshold pressure, routine 300 may indicate that the DI fuel rail priming of the green engine is complete at 312. In some examples, DI fuel rail pressure may be above the threshold pressure after a threshold number of combustion events have elapsed. Routine 300 then proceeds to 314, where a fuel injection profile may be adjusted based on engine operating conditions. Adjusting the fuel injection profile may include adjusting the fuel injection profile from a green engine start injection profile to one of a very cold engine start injection profile, a cold engine start injection profile, or a hot engine start injection profile based on engine temperature. As described in further detail with reference to FIG. 4, adjusting the fuel injection profile after the fuel pressure in the direct injection fuel rail is above the threshold pressure may include transitioning to injecting at least some fuel to the engine via the direct injector.

Otherwise, if DI fuel rail pressure has not increased above the first threshold pressure at 310, routine 300 proceeds to 316, where it is determined whether a threshold number of combustion events or a threshold number of green start events has elapsed. If this threshold number has not elapsed at 316, routine 300 returns to 308 to continue cranking the engine while combusting via only port fuel injection, and to continue priming the DI fuel rail. Thus, routine 300 may further comprise maintaining injection of fuel via the port injector until the fuel pressure in the direct injection fuel rail is above the threshold pressure or until a threshold number of combustion events since the green engine start have elapsed.

In one example, during the engine green start condition, injecting fuel from the port injector while priming the direct injection fuel rail may be continued until an integrated value based on a number of the one or more engine green start events and a duration of each of the one or more engine green start events has elapsed. In this example, determining whether the a green start condition has elapsed at 316 may include comparing the integrated value to a threshold value, and injecting fuel via only the port fuel injector may continue until the integrated value exceeds the threshold value.

If the DI fuel rail pressure has not increased while performing the port injection for the threshold number of combustion events or threshold number of green start events, it may be determined that the DI fuel rail has not primed and the proceeds to 318 to initiate a lengthy purge procedure to prime the DI fuel rail. Initiating the lengthier purge procedure may include, after the threshold number of combustion events, incrementing a direct injection amount while monitoring a signal from an exhaust gas sensor (e.g., sensor 128 at FIG. 1). As an example, a direct injection proportion of a total fuel injection mass (i.e., DI percentage) may be incremented while maintaining a desired total fuel injection mass. The purge procedure may terminate in response to the signal from the exhaust gas sensor indicating that an air-fuel ratio within a threshold tolerance of stoichiometry is maintained for a threshold number of injection events. In one example, if the exhaust gas sensor is not within the threshold tolerance of stoichiometry (e.g., if the air-fuel ratio deviates from an expected amount), a vehicle controller may adjust (e.g., update) an injection map based on the signal from the exhaust gas sensor and continue the purge procedure based on the updated injection map. The updating of the injection map may occur until the air-fuel ratio is determined to be within the threshold tolerance of stoichiometry. Thus, in some examples, the purge procedure may span a large duration (i.e., may be lengthy) due to the ensuring of stoichiometric combustion. As such, it may be desirable to only execute the purge procedure after the DI fuel rail is not primed via the green start priming.

Returning now to 306, if it is determined that an engine green start condition is not present, routine 300 proceeds to 322 to determine whether an engine cold start condition is present. As one example, determining whether an engine cold start condition is present may include determining whether an engine temperature (e.g., as inferred from a coolant temperature measured by temperature sensor 116 at FIG. 1) is below a threshold value, such as below an exhaust catalyst light-off temperature. In some examples, an engine cold start condition may include a very cold start condition, wherein engine temperature is at least a threshold magnitude less than the threshold value.

If an engine cold start condition is determined to be present at 322, routine 300 proceeds to 324, where the engine is cranked with fuel delivered according to a cold-start fuel injection profile. The cold-start fuel injection profile may include a fuel injection ratio of port:direct injected fuel mass that is adjusted based on engine temperature, a ratio of fuel delivered via port injection increased as the engine temperature decreases to reduce cold-start particulate matter emissions. It will be appreciated that delivering fuel according to the cold-start fuel injection profile may include delivering at least some fuel via the direct injector and at least some fuel via the port injector. In the example of the very cold start condition described above with regard to 322, fuel may be delivered according to a very cold start fuel injection profile which may including a different fuel injection ratio and injection timing from the cold-start profile. An example cold-start injection profile and a very coldstart fuel injection profile are described in further detail with reference to FIG. 4.

Additionally at 324, the DI fuel rail may be primed to a second, lower threshold pressure. It will be appreciated that the second threshold pressure may be based on one or more of a current engine speed, engine load, alcohol content of the fuel in the DI fuel rail, and engine temperature. It will be appreciated that the second threshold pressure is less than the first threshold pressure the DI fuel rail is primed to during the green engine start. As one example, the second threshold pressure may be a minimum default primed pressure of the DI fuel rail, and the first threshold pressure (e.g., as described with regard to 310) may be a fuel rail pressure that is further optimized for reduced soot emissions. Priming the DI fuel rail to the second threshold pressure may include priming for a second, smaller number of combustion events (e.g., smaller than the first number of combustion events described with regard to the green engine start at 316). The second number of combustion events may be determined based on a difference between a current fuel rail pressure (e.g., as measured by fuel rail pressure sensor 248 at FIG. 2) and the second threshold pressure. Thus, priming the DI fuel rail at 324 may include priming the DI fuel rail to a lower fuel pressure than the priming of the fuel rail to the first threshold pressure described with reference to 310. After 324, routine 300 terminates.

Returning to 322, if an engine cold start is determined not to be present, routine 300 proceeds to 326, where it is determined whether an engine hot start (i.e., a hot engine start) is present. As one example, determining whether an engine hot start condition is present may include determining whether the engine temperature (e.g., as inferred from a coolant temperature measured by temperature sensor 116 at FIG. 1) is above a threshold value (e.g., the threshold value described with regard to 322). If an engine hot start is not present, routine 300 terminates; otherwise, if an engine hot start is present, routine 300 proceeds to 328.

At 328, the engine is cranked with fuel delivered according to a hot-start fuel injection profile. It will be appreciated that delivering fuel according to the hot-start fuel injection profile may include delivering at least some fuel via the direct injector. An example hot-start injection profile is described in further detail with reference to FIG. 4.

Additionally at 328, the DI fuel rail may be primed to the second, lower threshold pressure. Similar to the priming described with regard to 324, priming the DI fuel rail to the second threshold pressure at 328 may include priming for the second duration. The second number of combustion events may be determined based on a difference between a current fuel rail pressure and the second threshold pressure. Thus, priming the DI fuel rail at 328 may include priming the DI fuel rail to a lower fuel pressure than the priming of the fuel rail to the first threshold pressure described with reference to 310. Additionally, when priming the DI fuel rail during a hot-start condition, each of direct injection and port fuel injection may be disabled (e.g., the direct injectors and the port injectors may be maintained in deactivated states). Put another way, during a non-green start condition, delivery of fuel may be delayed until the DI fuel rail has been primed via a cranking of the engine. As one example, the delivery of fuel may be delayed for a duration determined based on the DI fuel rail pressure. It will be appreciated that the duration for which delivery of fuel is delayed may be less than the duration of a green start priming (e.g., the duration described with regard to 316). After 328, routine 300 terminates.

As one example, in response to a green engine start, the engine may be cranked by injecting fuel from only a port injector while priming a direct injection fuel rail. In some examples, if priming the direct injection fuel rail while the engine is cranking via port injection does not result in a direct injection fuel rail pressure above a first, higher threshold pressure after a first duration (e.g., after a threshold number of combustion events or engine green start events have elapsed), the direct injection fuel rail may be primed via a purging process. Once the direct injection fuel rail has been primed, at least some fuel may be injected via the direct injector. As another example, in response to an engine cold start, the engine may be cranked while injecting fuel according to a cold-start fuel injection profile, which may include injecting at least some fuel from a direct injector. As a still further example, in response to an engine hot start, the engine may be cranked while injecting fuel according to a hot-start fuel injection profile, which may include injecting at least some fuel from the direct injector. During each of the engine cold start and engine hot start conditions, the DI fuel rail may be primed to a second, lower threshold pressure before enabling fuel injection (e.g., after a second duration).

Turning now to FIG. 4, it shows a table 400 including injection profiles 410, 420, 430, 440, 450, and 460 for a dual injection fuel system (e.g., fuel system 200 at FIG. 2). An injection profile for delivering fuel may be selected based on each of a temperature condition and an engine start condition. Specifically, with reference to routine 300, an engine controller may select one of injection profiles 410, 430, and 450 during start conditions that are not green engine start conditions (e.g., selected at 324 or 328 in response to one of a cold start or hot start), and a particular profile may be selected based on an engine temperature. Similarly, an engine controller may select one of injection profiles 420, 440, and 460 during green engine start conditions based on engine temperature. It will be appreciated that the fuel injection ratios depicted in table 400 are example injection ratios, and that the precise ratios may be adjusted based on engine temperature and/or fuel alcohol content.

Each injection profile includes one or more injection events comprising an injection amount and an injection timing. Injection events via the port injector are indicated by hatched bars, and direct injection events are indicated by solid bars. An injection amount (e.g., fuel mass) is indicated by an area of each bar of each injection event depicted in the injection profile, and injection timing is indicated along the horizontal axis of the page in relation to an intake stroke and a compression stroke of a piston cycle. Injection events occurring earlier within the span of a piston stroke (e.g., in the intake stroke) are depicted further toward the left side of the each profile, while later times within a piston stroke (e.g., in the compression stroke) are depicted further toward the right side of each profile.

Injection profile 410 may be selected during non-green engine start conditions wherein engine temperature is determined to be very cold (e.g., the very cold engine start described above with regard to 322 and 324). Injection profile 410 includes a single injection event 412. Injection event 412 includes injecting a first fuel amount via port injection during the intake stroke of the piston cycle. The relative timing of injection event 412 is earlier within the intake stroke than the injection events of injection profiles 430 and 450. By injecting a first amount of fuel via only port injection during an earlier part of the intake stroke, cold-start PM emissions may be reduced.

Injection profile 420 may be selected during green engine start conditions wherein engine temperature is determined to be very cold (e.g., a green engine start as described above with regard to 306 and 308, and a very cold engine temperature as described above with regard to 322). As another example, injection profile 420 may be selected during very cold engine start conditions wherein the fuel rail pressure is below a second, greater threshold pressure (e.g., wherein the DI fuel rail is being primed for a second, smaller number of combustion events as described with regard to 324 at FIG. 3). Injection profile 420 includes a single injection event 422. Injection event 422 includes injecting a second fuel amount via port injection during the intake stroke of the piston cycle. The second fuel amount is less than the first fuel amount of injection event 412.

In addition, during both the green engine very cold-start and non-green engine very cold-start, spark timing may be retarded, the amount of spark retard applied increased as engine temperature reduces.

Injection profile 430 may be selected during non-green engine start conditions wherein engine temperature is determined to be cold (e.g., the cold engine start described above with regard to 322 and 324). Injection profile 430 includes a port injection event 432 and a direct injection event 433. Port injection event 432 includes injecting a third fuel amount via port injection during the intake stroke of the piston cycle. The third fuel amount is less than the first fuel amount that is injected during injection event 412. The relative timing of injection event 432 is later within the intake stroke than the timing of injection event 412. By retarding a port injection event as engine temperature increases (e.g., from a very cold temperature condition to a cold temperature condition), cold-start emissions may be reduced. Direct injection event 433 includes injecting a fourth amount of fuel via the direct injectors at a time within occurs during the compression stroke of the cylinder cycle. It will be appreciated that the relative magnitudes of the third fuel amount and the fourth fuel amount (i.e., the fuel injection ratio of injection profile 430) may vary with engine temperature. As an example, the relative amount of direct injection may increase and the relative amount of port fuel injection may decrease as engine temperature increases. Additionally, the timings of each injection event 432 and 433 may vary with engine temperature. By injecting a portion of fuel during the compression stroke, heating of the engine may be improved. By injecting a first amount of fuel via port fuel injection during an intake stroke and injecting a second amount of fuel via direct injection during a compression stroke, cold-start fuel vaporization is improved.

Injection profile 440 may be selected during green engine start conditions wherein engine temperature is determined to be cold (e.g., a green engine start as described above with regard to 306 and 308, and a cold engine temperature as described above with regard to 322 at FIG. 3). As another example, injection profile 440 may be selected during cold engine start conditions wherein the fuel rail pressure is below a second, greater threshold pressure (e.g., wherein the DI fuel rail is being primed for a second number of combustion events). Injection profile 440 includes a single injection event 442. Injection event 442 includes injecting the second fuel amount (e.g., the same fuel amount as injection event 422) via port injection during the intake stroke of the piston cycle. The injection timing of 442 may be at a later time within the intake stroke than the timing of injection event 422. However, it will be appreciated in other examples the injection timing of 442 may be at the same time within the intake stroke as the timing of injection event 422. It will thus be appreciated that while injection profile 430 includes delivering fuel to the cylinder via each of PFI and DI during cold engine temperature conditions, injection profile 440 includes delivering fuel via only port injection due to the presence of a green engine start condition.

Injection profile 450 may be selected during non-green engine start conditions wherein engine temperature is determined to be hot (e.g., the hot engine start described above with regard to 326 and 328). Injection profile 450 includes a first direct injection event 451 and a second direct injection event 453. First DI event 451 includes directly injecting a fifth fuel amount at a first time during the intake stroke of the piston cycle, and second DI event 453 includes directly injecting the sixth fuel amount at a second time during the intake stroke. The fifth and sixth fuel amounts are each less than the first fuel amount that is injected during injection event 412. The relative timing of injection event 432 is later within the intake stroke than the timing of injection event 412.

Injection profile 460 may be selected during green engine start conditions wherein the engine temperature is determined to be hot (e.g., a green engine start as described above with regard to 306 and 308, and a hot engine temperature as described above with regard to 326 at FIG. 3). As another example, injection profile 460 may be selected during hot engine start conditions wherein the fuel rail pressure is below a second, greater threshold pressure (e.g., wherein the DI fuel rail is being primed for the second number of combustion events as described with regard to 328 at FIG. 3). Injection profile 460 includes a single injection event 462. Injection event 462 includes injecting the second fuel amount (e.g., the same fuel amount as injection events 422 and 442) via port injection during the intake stroke of the piston cycle. The injection timing of injection event 462 is at a later time within the intake stroke than the timing of each of injection event 422 and injection event 442. However, it will be appreciated in other examples the injection timing of 462 may be at the same time within the intake stroke as the timing of injection events 422 and 442. It will thus be appreciated that while injection profile 450 includes delivering fuel to the cylinder via only direct injection during hot engine temperature conditions, injection profile 460 includes delivering fuel via only port injection due to the presence of a green engine start condition.

It will be appreciated that during green engine start conditions, the fuel injection ratio and fuel injection amount is independent of engine temperature, ambient temperature, and/or any of the other parameters you normally use to determine the ratio. However, it will be further appreciated that fuel injection timing may depend on one of the aforementioned parameters during green engine start conditions.

In some examples, during drive cycles in which a green start condition elapses, a controller may adjust an injection profile from a green start profile (e.g., one of 420, 440, or 460) to a non-green engine start profile (e.g., one of 410, 430, or 450). With reference to routine 300 at FIG. 3, this injection profile adjustment may occur at 314. In such a scenario, if a direct injection event is present in the non-green engine start profile, the injection amounts of the DI events may be reduced for the remainder of the drive cycle. Thus, relatively less fuel may be injected via DI during the initial injection events of the vehicle after assembly, as compared to subsequent injection events. Put another way, an injector control routine may include, during an engine green start condition, after the first number of combustion events, transitioning to injecting fuel with a first ratio of direct injection mass to port injection mass; and during the second engine start condition, after the second number of combustion events, transitioning to injecting fuel with a second, different ratio of direct injection mass to port injection mass, wherein the first ratio is less than the second ratio. In this way, control of the direct injectors may be increased.

In some examples, after transitioning from the green start condition to standard injector operation, a fuel injection ratio of an injection profile may be adjusted based on one or more of engine temperature and fuel alcohol content. Therein, the ratio may be adjusted by smaller amounts that would have otherwise been applied (e.g., by smaller amounts than when adjusting after an engine start wherein one of a hot-start condition or a cold-start condition is detected). In this way, greater injector control may be achieved.

Turning now to FIG. 5, a prophetic sequence for adjusting a fuel injector ratio based on an engine start condition, selectively priming the DI fuel rail based on a DI fuel rail pressure, and operating a port fuel injector and direct injector based on the fuel injection ratio are shown. Although not explicitly shown, the injection ratio may also adjusted based on a fuel alcohol content. The sequences of FIG. 5 may be provided by the system of FIG. 1 according to the method of FIG. 3.

Vertical markers t1-t9 represent times of interest during the operating sequence. As one example, the durations of each of a green engine start condition, a cold engine start condition, and a hot engine start condition are indicated along the X axis below the fourth plot 540. It will be appreciated that a break in time is indicated by the two parallel diagonal lines on the X axis between times t5 and t6.

The first plot 510 of FIG. 5 is a plot of fuel injection ratio 512 (e.g., as described in the previous paragraph) versus time. In one example, the fuel injection ratio may increase as the engine temperature increases, and decrease as the engine temperature decreases. The Y axis represents fuel injection ratio (e.g., 240 of FIG. 2), and the ratio increases toward exclusively direct injection in the direction of the Y axis arrow. It will be appreciated that plot 510 is not meant to indicate precise ratios between the benchmark values of 1:0 and 0:1. Additionally, information regarding a total injection mass is not represented by plot 510, only a relative proportion of port fuel injection to direct injection. It will be further appreciated that an engine controller (e.g., 222 at FIG. 2) may adjust a direct injection fuel ratio by sending appropriate signals to injection drivers 237 and 238, which may in turn actuate the direct fuel injectors 252 and the port fuel injectors 262 with desired pulse-widths for achieving the desired injection ratios. The X axis represents time and time increases in the direction of the X axis arrow.

The second plot 520 of FIG. 5 is a plot of DI fuel rail pressure 522 versus time. In one example, the fuel rail pressure may increase during a DI fuel rail priming event, and may decrease during a direct injection event. It will also be appreciated that DI fuel rail pressure may increase when the fuel rail is pressurized by a high pressure fuel pump. The Y axis represents DI fuel rail pressure (e.g., fuel pressure within fuel rail 250 at FIG. 2, as measured by pressure sensor 248 affixed therein), and the fuel pressure increases in the direction of the Y axis arrow. The X axis represents time and time increases in the direction of the X axis arrow.

Horizontal line 521 represents a lower threshold pressure, which as shown may vary based on an engine condition. For example, the lower threshold pressure 521 may be a first, greater pressure during green engine start conditions, and may be a second, lower pressure during engine cold start and/or engine hot start conditions, as depicted at plot 520.

The third plot 530 of FIG. 5 is a plot of engine temperature versus time. The Y axis represents engine temperature (e.g., as measured by or inferred from ECT sensor 116 at FIG. 1), and the temperature increases in the direction of the Y axis arrow. The X axis represents time and time increases in the direction of the X axis arrow. Horizontal line 531 represents a threshold temperature, such as the threshold temperature described with reference to 322 and 326 at FIG. 3.

The fourth plot 540 of FIG. 5 is a plot of engine speed (e.g., crankshaft revolutions per unit time) versus time. In one example, the engine speed may rise and fall during a drive sequence, and may be at zero between key-off and key-on events. The Y axis represents engine speed (e.g., as inferred from a profile ignition pickup signal (PIP) generated from Hall effect sensor 120 (or other type) coupled to crankshaft 140 at FIG. 1), and the engine speed in the direction of the Y axis arrow. The X axis represents time and time increases in the direction of the X axis arrow. Horizontal line 541 represents a minimum engine speed (e.g., one of zero or idle).

Turning now to t1, it represents an engine start event (e.g., a key-on event). Specifically, the engine start at time t1 is the initial key-on event after vehicle assembly. In other words, an engine green start condition is present at time t1. Fuel pressure 522 is less than threshold pressure 521. Thus, priming of the DI fuel rail is desired. Accordingly, fuel injection ratio 512 is commanding injection via only PFI, as indicated by the fully horizontal trend of line 512 at the bottom end of plot 510. As one example, at time t1, fuel may be injected according to injection profile 420 at FIG. 4.

Between t1 and t2, as engine speed 542 increases, and each of DI fuel rail pressure 522 increases. Injection is only via PFI for each prophetic sequence between times t1 and t2. Additionally, the drive cycle initiated at t1 ends between times t1 and t2.

Time t2 represents a second key-on event. Thus, it will be appreciated that each of the green start condition may span a number of drive cycles, rather than just a first key-on event. Between times t2 and t3, engine speed increases, and DI fuel rail pressure 522 increases while remaining below threshold pressure 521. Thus, injection ratio 512 is maintained as entirely port injection while priming of the DI fuel rail is continued. Additionally, engine temperature 532 increases between times t2 and t3, but remains below threshold temperature 531.

Time t3 represents a third key-on event. Between times t3 and t4, engine speed increases, and DI fuel rail pressure 522 increases while remaining below threshold pressure 521. Thus, injection ratio 512 is maintained as injecting entirely via port injection while priming of the DI fuel rail is continued. Additionally, engine temperature 532 increases between times t3 and t4, but remains below threshold temperature 531.

At time t4, DI fuel rail pressure 522 increases to greater than threshold pressure 521. Accordingly, direct injectors are activated, as indicated by injection ratio 512 increasing from only port fuel injection to a ratio including more port fuel injection than direct fuel injection (e.g., transitioning from injecting via injection profile 440 to injecting via injection profile 430). It will be appreciated, then, that the green engine start condition is no longer present at t4 and that the DI fuel rail priming is complete at time t4. After time t4, engine temperature 532 increases, and injection ratio 512 also increases in response to the temperature increase. Also after time t4, engine speed 542 returns to base level 541, indicating the end of the third drive cycle.

A gap in time is indicated by the break in the X axis between times t4 and t5. Between times t4 and t5, the vehicle may have left the assembly plant and may have been sold to an end user. Additionally, during the gap in time fuel pressure threshold 521 may have decreased from the first, greater threshold to the second, smaller threshold in response to the completion of the green engine start condition. In this way, during the first green engine start condition, the direct injection fuel rail may be primed to a higher fuel rail pressure, and during a second engine start condition (e.g., one of a hot-start or a cold-start condition, as described below in further detail), the direct injection fuel rail may be primed to a lower fuel rail pressure.

Time t5 represents a fourth key-on event. A cold engine condition is present, as indicated by engine temperature 532 remaining below threshold temperature 531. Direct injection fuel rail pressure 522 is below the threshold pressure 521, and responsive to this condition, the direct fuel injectors may be deactivated and fuel delivery to the engine may occur via only PFI (e.g., the injectors may deliver fuel to the engine according to injection profile 440 at FIG. 4).

Between times t5 and t6, priming of the DI fuel rail occurs for a second number of combustion events (e.g., a second number of combustion events may elapse between times t5 and t6). As a result, fuel rail pressure 522 increases to above threshold pressure 521. Thus, at time t6, the direct injectors are reactivated. Additionally, engine temperature 532 remains below threshold temperature 531. At t6, then, fuel may be injected via a cold-start fuel injection profile, such as injection profile 430 shown at FIG. 4.

Between times t6 and t7, engine temperature 532 increases, but remains below threshold temperature 531. As a result, injection ratio 512 increases toward a larger proportion of DI to PFI. At time t7, engine temperature 532 reaches threshold temperature 531. As a result, fuel may be delivered to the engine according to a hot-start injection profile. This is depicted by an increase in injection ratio 512 from a first injection ratio (e.g., injecting via each of PFI and DI according to injection profile 430 shown at FIG. 4) to a second fuel injection ratio (e.g., injecting via only DI according to injection profile 450 at FIG. 4).

Between times t7 and t8, engine speed returns to base level 541. Additionally, DI fuel rail pressure 522 decreases to below the threshold pressure 521. Time t8 indicates a fifth key-on event. Because DI fuel rail pressure is below the threshold pressure 521, fuel is injected via PFI only. Between times t7 and t8, priming of the DI fuel rail occurs for the second number of combustion events (e.g., a second number of combustion events may elapse between times t5 and t6). As a result, fuel rail pressure 522 increases to above threshold pressure 521. Thus, at time t8, the direct injectors are reactivated. Additionally, engine temperature 532 remains above threshold temperature 531. At t8, then, fuel may be injected via a hot-start fuel injection profile, such as injection profile 450 shown at FIG. 4.

Thus, as depicted at FIG. 5, a method for controlling a vehicle engine may include, during a first engine green start condition, priming a direct injection fuel rail while delivering fuel via a port injector for a first, larger number of combustion events (e.g., the number of combustion events that elapse between times t1 and t4); and during a second engine non-green start condition, the method may include priming the direct injection fuel rail while delivering fuel via the port injector for a second, smaller number of combustion events (e.g., the number of combustion events that elapse between t5 and t6 or between times t8 and t9).

Also as depicted at FIG. 5, a method for controlling a vehicle engine may further comprise, after injecting for the first number of combustion events in response to a green start, fuel may be injected according to a first injection ratio, and after injecting for the second number of combustion events in response to a second start condition, fuel may be injected according to a second injection ratio, said first ratio less than said second ratio. Specifically, this is shown at plot 510 by a first fuel injection ratio at time t4 and a second fuel injection ratio at one of times t6 or t9.

In a first example, the present invention contemplates a method for controlling fuel injection to an engine, comprising in response to an engine green start, cranking the engine by injecting fuel from a port injector while priming a direct injection fuel rail. In a first embodiment, the method of the first example includes wherein the engine is coupled in a vehicle and wherein the engine green start event is a first engine start of the vehicle after vehicle assembly. In a second embodiment, which optionally includes the first embodiment, the method of the first example further comprises not injecting fuel to the engine via a direct injector while priming the direct injection fuel rail. In a third embodiment, which optionally includes one or more of the first and second embodiments, the first example method includes wherein fuel pressure in the direct injection fuel rail is less below a threshold pressure during the engine green start. In a fourth embodiment, which optionally includes one or more of the first through third embodiments, the first example method further comprises maintaining injection of fuel via the port injector until one of the fuel pressure in the direct injection fuel rail is above the threshold pressure or a threshold number of combustion events since the green start have elapsed. In a fifth embodiment, which optionally includes one or more of the first through fourth embodiments, the first example method further comprises transitioning to injecting at least some fuel to the engine via the direct injector after one of the fuel pressure in the direct injection fuel rail is above the threshold pressure and the threshold number of combustion events since the green start have elapsed. In a sixth embodiment, which optionally includes one or more of the first through fifth embodiments, the first example method comprises wherein the transitioning includes adjusting a ratio of fuel delivered via the direct injector mass to fuel delivered via the port injector based on engine temperature, the ratio of fuel delivered via the direct injector increased as engine temperature increases. In a seventh embodiment, which optionally includes one or more of the first through sixth embodiments, the first example method includes wherein the ratio is further adjusted based on fuel alcohol content. In an eighth example embodiment, which optionally includes one or more of the first through seventh example embodiments, the first example method further comprises, pressurizing each of a port injection fuel rail coupled to the port injector and the direct injection fuel rail via a common high pressure fuel pump. In a ninth example embodiment, which optionally includes one or more of the first through eighth example embodiments, the engine green start of the first example method includes one or more engine green start events, and the injecting fuel from the port injector while priming the direct injection fuel rail is continued until an integrated value based on a number of the one or more engine green start events and a duration of each of the one or more engine green start events is higher than a threshold value.

In a second example, the present invention contemplates a method for controlling a vehicle engine, comprising: during a first engine green start condition, priming a direct injection fuel rail while delivering fuel via a port injector for a first, duration; and during a second engine non-green start condition, priming a direct injection fuel rail while delivering fuel via the port injector for a second, smaller duration. In a first embodiment, the first engine green start condition of the second example includes an engine start while following assembly of the vehicle at a plant and before the vehicle leaves the plant, the first engine green start condition independent of engine temperature at engine start, and wherein the second engine non-green start condition includes one of an engine cold-start and an engine hot-start condition. In a second embodiment, which optionally includes the first embodiment, the second example method further comprises: during the first engine green start condition, after the first duration, transitioning to injecting fuel with a first ratio of direct injection mass to port injection mass. In a third embodiment, which optionally includes one or more of the first and second embodiments, the second example method comprises: during the second engine non-green start condition, after the second duration, transitioning to injecting fuel with a second, different ratio of direct injection mass to port injection mass, wherein the first ratio is less than the second ratio. In a fourth embodiment, which optionally includes one or more of the first through third embodiments, the second example method includes wherein during the first engine start condition, the direct injection fuel rail is primed to a higher fuel rail pressure and wherein during the second engine start condition, the direct injection fuel rail is primed to a lower fuel rail pressure. In a fifth embodiment, which optionally includes one or more of the first through fourth embodiments, the second example method further comprises wherein the first duration is based on a threshold number of combustion events, and during the first engine green start condition, in response to a fuel pressure of the direct injection fuel rail remaining below a threshold pressure after the first number of combustion events have elapsed, initiating a direct injection fuel rail purging routine.

As a third example, a fuel system of the present invention comprises a first fuel rail coupled to a direct injector, a second fuel rail coupled to a port injector, a first fuel pressure sensor coupled to the first fuel rail, a second fuel pressure sensor coupled to the second fuel rail, a high pressure mechanical pump delivering fuel to each of the first and second fuel rails, said high pressure fuel pump including no electrical connecting to a controller. In one example embodiment, the first fuel rail is coupled to an outlet of the high pressure fuel pump and the second fuel rail is coupled to an inlet of the high pressure fuel pump. As another example embodiment, any of the preceding embodiments of the third example may additionally or alternatively comprise a control system with computer readable instructions for, in response to a detected green start condition (e.g., a green engine start condition), selectively enabling the first port injector while maintaining the second direct injector disabled and delivering fuel to each of the first and second fuel rails via the high pressure mechanical pump (e.g., via control of a spill valve) until a fuel pressure in the first fuel rail is above a threshold. As another example embodiment, any of the above embodiments of the third example may additionally or alternatively be configured to intermittently enable the direct injector to purge air form the first fuel rail into the engine. As another example embodiment, the control system of one or more of the above embodiments of the third example may additionally or alternatively determine the green start condition based on a number of key-on events and a duration elapsed after an initial key-on event after vehicle assembly. As another example embodiment, the control system of one or more of the above embodiments of the third example may additionally or alternatively determine the green start condition based on a signal from the first fuel rail pressure sensor. As another example embodiment, the controller of one or more of the above embodiments of the third example may additionally or alternatively be configured to enable the direct injector in response to a fuel rail pressure in the first fuel rail rising above a threshold pressure.

In another representation a method for controlling a fuel injection ratio of a dual injection fuel system is contemplated, comprising: in response to an engine start event wherein a direct injection fuel rail pressure is below a threshold pressure, injecting a total injection mass via the first port injector. In a first example, the method may further comprise injecting a larger proportion of the total injection mass via the first injector, and injecting a smaller proportion of the total injection mass via the second injector; in response to an engine start event wherein a direct injection fuel rail pressure is above the threshold pressure and an engine temperature is below a threshold temperature. In a second example, which optionally includes the first example, the method further includes injecting a smaller proportion of the total injection mass via the first injector, and injecting a larger proportion of the total injection mass via the second injector. In response to an engine start event wherein the direct injection fuel rail pressure is above the threshold pressure and the engine temperature is above the threshold temperature. In a third example, optionally including one or more or each of the first and second examples, the injection ratio may be further determined based on a fuel alcohol content. In a fourth example, optionally including one or more or each of the first through third examples, the method includes wherein the threshold pressure is determined based on each of a desired injection mass and a desired fuel ratio. In a fifth example, optionally including one or more or each of the first through fourth examples, the method further comprises decreasing a proportion of the total injection mass injected via the first port injector and increasing a proportion of the total injected via the second direct injector in response to the direct injection fuel rail pressure increasing above the threshold pressure. In a sixth example, optionally including one or more or each of the first through fifth examples, the method further comprises decreasing the proportion of the total injection mass injected via the first port injector by a predetermined amount, and increasing the proportion of the total injection mass injected via the second direct injector by the predetermined amount in response to the engine temperature increasing above the threshold temperature and the direct injection fuel rail maintained above the threshold pressure. In a seventh example, optionally including one or more or each of the first through sixth examples, the predetermined amount by with the injection ratio is increased is based on a previous fuel injection ratio.

In this way, by operating performing green start tests while injecting via only port injection and priming a direct injection fuel rail, a priming time required is reduced and a time a vehicle spends at a plant after being assembled/manufactures can be reduced. Additionally, by only injecting via DI after the DI fuel rail has been primed to a threshold pressure, soot emissions may be reduced.

The technical effect of injecting via only port fuel injection while priming the direct injection fuel rail during green start conditions is to reduce vehicle manufacture times. By injecting via only port fuel injection while priming the direct injection fuel rail during green start conditions, soot emissions associated with direct injection at low DI fuel rail amounts and pressures are reduced. The technical effect of injecting fuel at a lower ratio of direct injection to port fuel injection upon transitioning from an engine green start condition to a standard injection procedure is to improve direct injector control. A further technical effect of injecting fuel via only port fuel injection while priming the direct injection fuel rail during green start conditions is to reduce spark plug fouling. A still further technical effect of injecting fuel via only port fuel injection while priming the direct injection fuel rail during green start conditions is to reduce the probability of engine stalls during vehicle production, thereby increasing production times of vehicles.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for controlling fuel injection to an engine, comprising:

in response to an engine green start, cranking the engine by injecting fuel from a port injector while priming a direct injection fuel rail.

2. The method of claim 1, wherein the engine is coupled in a vehicle and wherein the engine green start is a first engine start of the vehicle after vehicle assembly.

3. The method of claim 1, further comprising:

while priming the direct injection fuel rail, not injecting fuel to the engine via a direct injector.

4. The method of claim 3, wherein during the engine green start, fuel pressure in the direct injection fuel rail is below a threshold pressure.

5. The method of claim 4, further comprising:

maintaining injection of fuel via the port injector until one of the fuel pressure in the direct injection fuel rail is above the threshold pressure or a threshold number of combustion events since the green start has elapsed.

6. The method of claim 5, further comprising:

after one of the fuel pressure in the direct injection fuel rail is above the threshold pressure and the threshold number of combustion events since the green start has elapsed, transitioning to injecting at least some fuel to the engine via the direct injector.

7. The method of claim 6, wherein the transitioning includes adjusting a ratio of fuel delivered via the direct injector to fuel delivered via the port injector based on engine temperature, the ratio of fuel delivered via the direct injector increased as engine temperature increases.

8. The method of claim 7, wherein the ratio is further adjusted based on fuel alcohol content.

9. The method of claim 1, further comprising pressurizing each of a port injection fuel rail coupled to the port injector and the direct injection fuel rail via a common high pressure fuel pump.

10. The method of claim 1, wherein the engine green start includes one or more engine green start events, and wherein the injecting fuel from the port injector while priming the direct injection fuel rail is continued until an integrated value based on a number of the one or more engine green start events and a duration of each of the one or more engine green start events is higher than a threshold value.

11. A method for controlling a vehicle engine, comprising:

during a first engine green start condition, priming a direct injection fuel rail while delivering fuel after a first delay amount via a port injector for a first, larger duration; and during a second engine non-green start condition, priming the direct injection fuel rail while delivering fuel after a second, larger delay amount via the port injector for a second, smaller duration.

12. The method of claim 11, wherein the first engine green start condition includes an engine start following assembly of the vehicle at a plant and before the vehicle leaves the plant, the first engine green start condition independent of engine temperature at engine start, and wherein the second engine non-green start condition includes one of an engine cold-start and an engine hot-start condition.

13. The method of claim 11, further comprising:

during the first engine green start condition, after the first duration, transitioning to injecting fuel with a first ratio of direct injection mass to port injection mass; and during the second engine non-green start condition, after the second duration, transitioning to injecting fuel with a second, different ratio of direct injection mass to port injection mass, wherein the first ratio is less than the second ratio.

14. The method of claim 11, wherein during the first engine green start condition, the direct injection fuel rail is primed to a higher fuel rail pressure and wherein during the second engine non-green start condition, the direct injection fuel rail is primed to a lower fuel rail pressure.

15. The method of claim 11, further comprising:

wherein the first duration is based on a threshold number of combustion events; and during the first engine green start condition, in response to a fuel pressure of the direct injection fuel rail remaining below a threshold pressure after the threshold number of combustion events has elapsed, initiating a direct injection fuel rail purging routine.

16. A fuel system, comprising:

a first fuel rail coupled to a direct injector;

a second fuel rail coupled to a port injector;

a first fuel pressure sensor coupled to the first fuel rail;

a second fuel pressure sensor coupled to the second fuel rail;

a high pressure mechanical fuel pump delivering fuel to each of the first and second fuel rails, the high pressure fuel pump including no electrical connection to a controller, the first fuel rail coupled to an outlet of the high pressure mechanical fuel pump, the second fuel rail coupled to an inlet of the high pressure mechanical fuel pump; and a control system with computer readable instructions for:

in response to a detected green start condition, selectively enabling the port injector while maintaining the direct injector disabled; and delivering fuel to each of the first and second fuel rails via the high pressure mechanical fuel pump until a fuel pressure in the first fuel rail is above a threshold.

17. The system of claim 16, further comprising intermittently enabling the direct injector to purge air from the first fuel rail into the engine.

18. The system of claim 17, wherein the green start condition is determined based on a number of key-on events and a duration elapsed after an initial key-on event after vehicle assembly.

19. The system of claim 17, wherein the green start condition is determined based on a signal from the first fuel pressure sensor.

20. The system of claim 17, wherein the controller is further configured to enable the direct injector in response to the fuel pressure in the first fuel rail rising above the threshold.

* * * * *